US009087666B2

(12) United States Patent
Liu et al.

(10) Patent No.: US 9,087,666 B2
(45) Date of Patent: Jul. 21, 2015

(54) METHOD FOR MAKING CARBON NANOTUBE FIELD EMITTER

(71) Applicants: Peng Liu, Beijing (CN); Kai-Li Jiang, Beijing (CN); Shou-Shan Fan, Beijing (CN)

(72) Inventors: Peng Liu, Beijing (CN); Kai-Li Jiang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 217 days.

(21) Appl. No.: 13/711,946

(22) Filed: Dec. 12, 2012

(65) Prior Publication Data

US 2014/0030950 A1 Jan. 30, 2014

(30) Foreign Application Priority Data

Jul. 26, 2012 (CN) ..... 2012 1 02608898

(51) Int. Cl.

| | |
|---|---|
| ***H01J 9/02*** | (2006.01) |
| ***H01J 1/304*** | (2006.01) |
| ***H01J 31/12*** | (2006.01) |

(52) U.S. Cl.

CPC ..... *H01J 9/025* (2013.01); *H01J 1/304* (2013.01); *H01J 31/123* (2013.01)

(58) Field of Classification Search

CPC ..... H01J 9/025

See application file for complete search history.

(56) References Cited

U.S. PATENT DOCUMENTS

| | | | | |
|---|---|---|---|---|
| 2008/0075954 | A1* | 3/2008 | Wardle et al. | 428/339 |
| 2008/0248235 | A1* | 10/2008 | Feng et al. | 428/113 |
| 2009/0218930 | A1* | 9/2009 | Lee et al. | 313/496 |

* cited by examiner

*Primary Examiner* — Elmito Breval

(74) *Attorney, Agent, or Firm* — Novak Druce Connolly Bove + Quigg LLP

(57) ABSTRACT

A method for making a carbon nanotube field emitter is disclosed. The method includes steps of providing a carbon nanotube layer having a first surface and a second surface opposite to each other, wherein the first surface is divided into a first area and a second area along a first direction by a line, coating a metal layer on the first area of the first surface, and rolling the coated carbon nanotube layer around the first direction to form the carbon nanotube field emitter.

20 Claims, 22 Drawing Sheets

METHOD FOR MAKING CARBON NANOTUBE FIELD EMITTER

CROSS-REFERENCE TO RELATED APPLICATIONS

This application claims all benefits accruing under 35 U.S.C. §119 from China Patent Application No. 201210260889.8, filed on Jul. 26, 2012 in the China Intellectual Property Office. This application is also related to the application Ser. No. 13/711,982 entitled, "CARBON NANOTUBE FIELD EMITTER", filed Dec. 12, 2012. Disclosures of the above-identified applications are incorporated herein by reference.

BACKGROUND

1. Technical Field

The present disclosure relates to methods for making field emitters and, particularly, to a method for making a carbon nanotube field emitter.

2. Description of Related Art

Carbon nanotube has excellent electrical and mechanical properties. The carbon nanotube can transmit extremely high current density and emit electrons easily at low voltages. Thus it can be used as a field emitter in a variety of display devices, such as field emission display devices.

The two main methods for making a carbon nanotube field emitter are the in-situ synthesis method and the printing method.

An in-situ synthesis method is performed by coating metal catalysts on a conductive cathode electrode and directly growing carbon nanotubes on the conductive cathode electrode by chemical vapor deposition. However, the carbon nanotubes synthesized on the cathode electrode are inevitably entangled with each other. Thus, the field emission characteristics of the carbon nanotubes are generally unsatisfactory. Furthermore, the carbon nanotube field emitter has relatively low mechanical properties.

A printing method is performed by printing a pattern on a conductive cathode electrode using carbon nanotube based conductive paste or organic binder. The carbon nanotubes can extrude from the pattern to form emitters by a series of treating processes. However, the density of the effective carbon nanotube emitters is relatively low, and the carbon nanotubes are easily entangled with each other and are oblique to the conductive cathode electrode. Furthermore, the treating processes may include a step of peeling the paste off to form extrusions of the carbon nanotubes. Such peeling step may damage the carbon nanotubes and/or decrease their performance. Thus, the efficiency of the carbon nanotube field emitter obtained by the printing method is relatively low, and controllability of the printing method is often less than desired. What is needed, therefore, is to provide a method for making carbon nanotube field emitters, in which the carbon nanotube field emitter has stable field emission performance and high mechanical properties, and the method can be utilized easily.

BRIEF DESCRIPTION OF THE DRAWINGS

Many aspects of the present disclosure can be better understood with reference to the following drawings. The components in the drawings are not necessarily to scale, the emphasis instead being placed upon clearly illustrating the principles of the present embodiments.

DETAILED DESCRIPTION

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean at least one.

Figure 1:
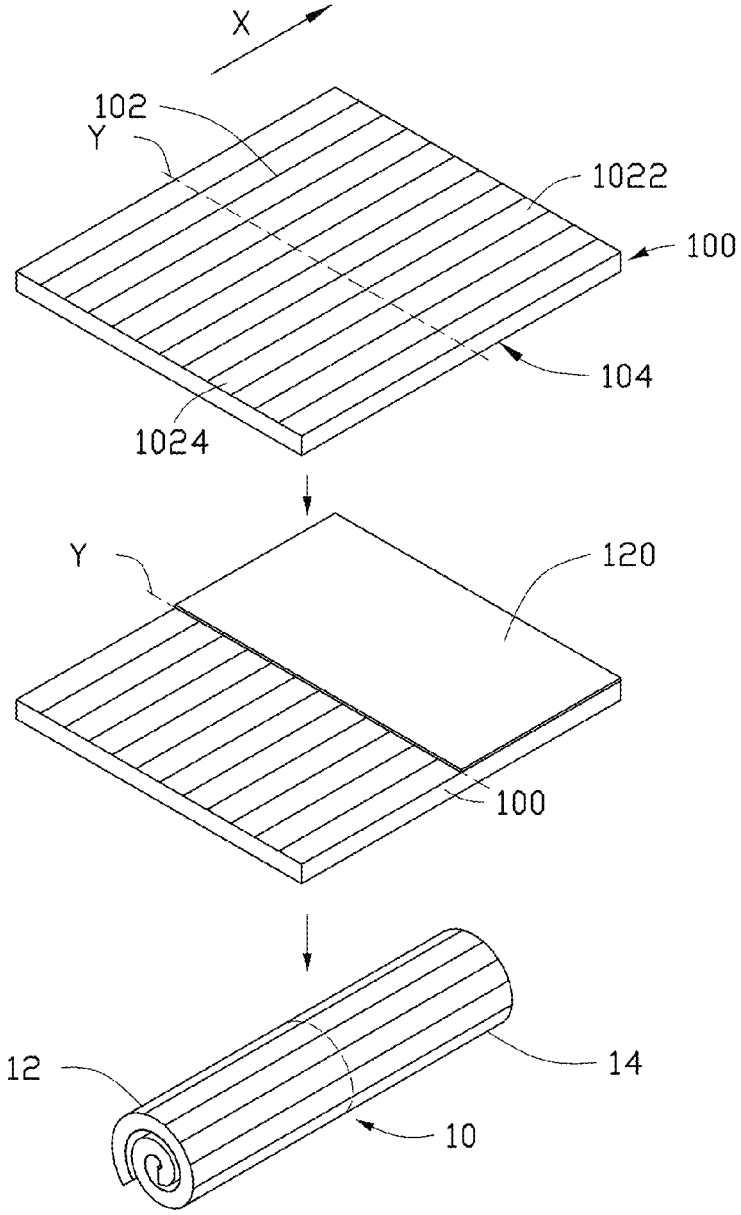
FIG. 1 is a schematic flowchart of a method for making carbon nanotube field emitter according to one embodiment.

Referring to FIG. 1, a method for making a carbon nanotube field emitter 10 according to one embodiment includes the steps of:

(S1) providing a carbon nanotube layer 100 having a first surface 102 and a second surface 104 opposite to each other, wherein the first surface 102 is divided into a first area 1022 and a second area 1024 along a first direction X by a line Y;

(S2) coating a metal layer 120 on the first area 1022; and (S3) taking the first surface 102 as an inner surface and rolling the coated carbon nanotube layer 100 around the first direction X to form the carbon nanotube field emitter 10.

In step (S1), the carbon nanotube layer 100 is a flexible free-standing structure including a plurality of carbon nanotubes. In one embodiment, the carbon nanotube layer 100 consists of a plurality of carbon nanotubes. The adjacent carbon nanotubes in the carbon nanotube layer 100 are joined end to end by van der Waals attractive force. The plurality of carbon nanotubes in the carbon nanotube layer 100 is aligned along the first direction X and substantially parallel to each other. In one embodiment, the line Y is a straight line and perpendicular to the first direction X.

Figure 2:
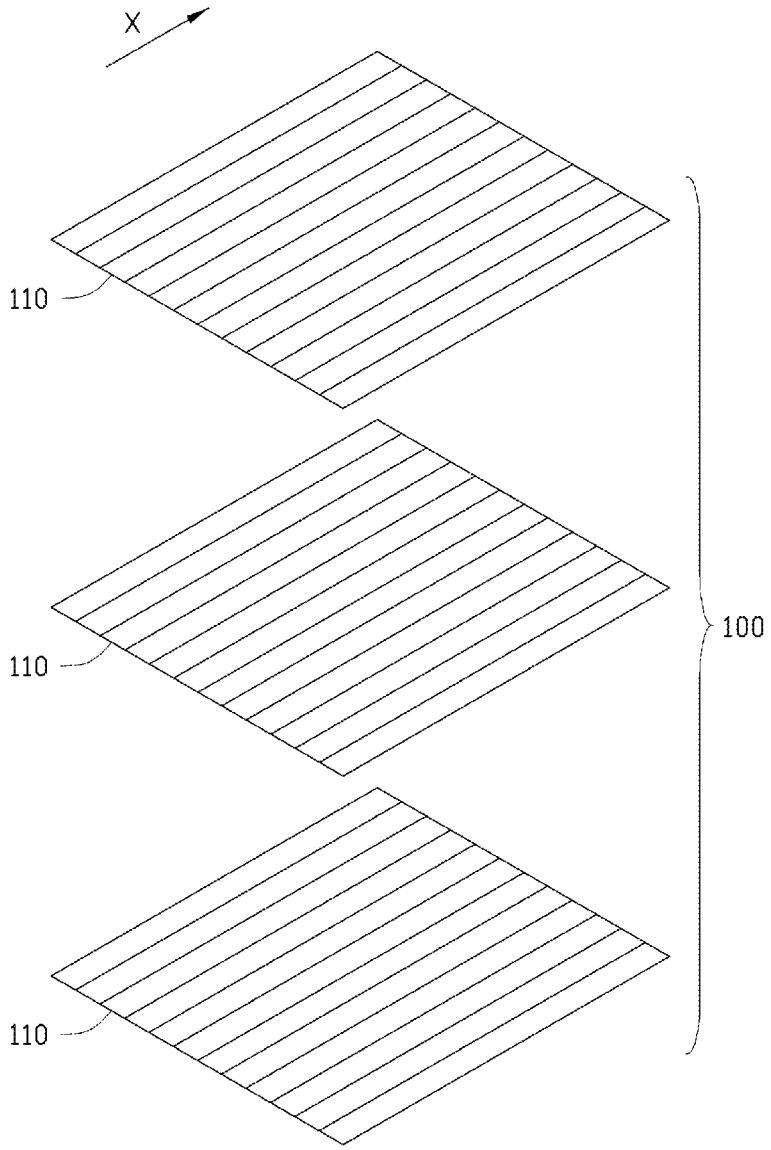
FIG. 2 is a schematic diagram of a carbon nanotube layer used in the method of FIG. 1.

The carbon nanotube layer 100 includes at least one carbon nanotube drawn film 110. Referring to FIG. 2, the carbon nanotube layer 100 can comprise or consist of three carbon nanotube drawn films 110 stacked with each other. Alternatively, the carbon nanotube layer 100 can consists of one carbon nanotube drawn film 110. The thickness of the carbon nanotube layer 100 can range from 5 nanometers to 100 microns.

Figure 3:
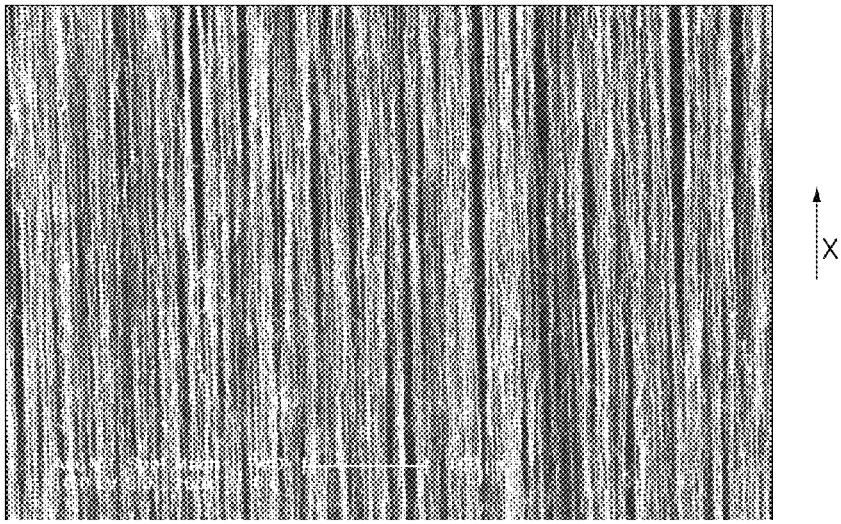
FIG. 3 is a scanning electron microscope image of a carbon nanotube film in the carbon nanotube layer of FIG. 2.

Referring to FIG. 3, each of the at least one carbon nanotube drawn film 110 includes a plurality of oriented carbon nanotubes joined end to end by van der Waals attractive force. If the carbon nanotube layer 100 consists of a plurality of carbon nanotube drawn films 110 stacked with each other, all of the carbon nanotubes are substantially aligned along the first direction X.

The carbon nanotube drawn film 110 can be formed by the steps of:

(a) providing an array of carbon nanotubes or a super-aligned array of carbon nanotubes;

(b) selecting a plurality of carbon nanotube segments having a predetermined width from the array of carbon nanotubes; and (c) pulling the carbon nanotube segments at an even speed to form a carbon nanotube drawn film.

In step (a), the super-aligned array of carbon nanotubes can be formed by substeps of:

(a1) providing a substantially flat and smooth substrate;

(a2) forming a catalyst layer on the substrate;

(a3) annealing the substrate with the catalyst layer in air at a temperature ranging from 700° C. to 900° C. for about 30 minutes to 90 minutes;

(a4) heating the substrate with the catalyst layer at a temperature ranging from 500° C. to 740° C. in a furnace in protective gas; and (a5) supplying a carbon source gas to the furnace for about 5 minutes to 30 minutes and growing a super-aligned array of carbon nanotubes from the substrate.

The super-aligned array of carbon nanotubes can be approximately 50 microns to 900 microns in height, and includes a plurality of carbon nanotubes parallel to each other and substantially perpendicular to the substrate. The super-aligned array of carbon nanotubes formed under the above conditions is essentially free of impurities, such as carbonaceous or residual catalyst particles. The carbon nanotubes in the super-aligned array are packed together closely by van der Waals attractive force.

In step (b), the carbon nanotube segments having a predetermined width can be selected using an adhesive tape to contact with the super-aligned array.

In step (c), the pulling direction is substantially perpendicular to the growing direction of the super-aligned array of carbon nanotubes. Specifically, during the pulling process, as the initial carbon nanotube segments are drawn out, other carbon nanotube segments are also drawn out end to end due to the van der Waals attractive force between ends of adjacent segments. This process of drawing ensures a successive carbon nanotube drawn film having a predetermined width can be formed.

The width of the carbon nanotube drawn film 110 depends on the size of the carbon nanotube array. The length of the carbon nanotube drawn film 110 can be arbitrarily set as desired. In one embodiment, the substrate is a 4 inch type wafer, and the width of the carbon nanotube drawn film 110 is in the range of 10 microns to 10 centimeters and the thickness of the carbon nanotube film is in the range of 5 nanometers to 10 microns.

In step (S2), the coating process can be accomplished by brushing, printing, rolling, dipping, spraying, evaporating, or spin coating. Evaporating is used to coat the metal layer 120 onto the first area 1022 of the first surface 102 in one embodiment. A material of the metal layer 120 can be gold, silver, copper, or nickel. Silver is selected as the material of the metal layer 120 in one embodiment. The thickness of the metal layer 120 can be in a range from 5 nanometers to 100 microns.

In step (S3), the carbon nanotube field emitter 10 is formed by rolling the coated carbon nanotube layer 100 around the first direction X. Specifically, by rolling the second area 1024 of the first surface 102 in the carbon nanotube layer 100, an emission portion 12 is formed. By rolling the coated first area 1022 of the first surface 102 in the carbon nanotube layer 100, a supporting portion 14 is formed. The emission portion 12 and the supporting portion 14 are formed as one carbon nanotube field emitter 10.

Figure 4:
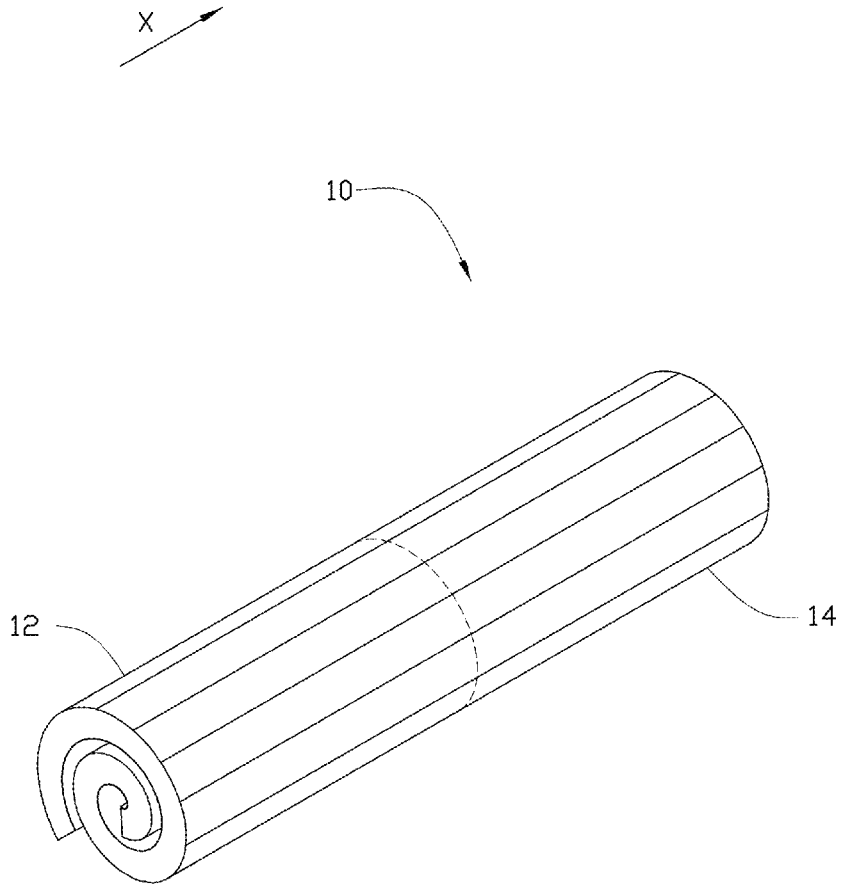
FIG. 4 is a schematic diagram of a carbon nanotube field emitter made by the method of FIG. 1.
Figure 5:
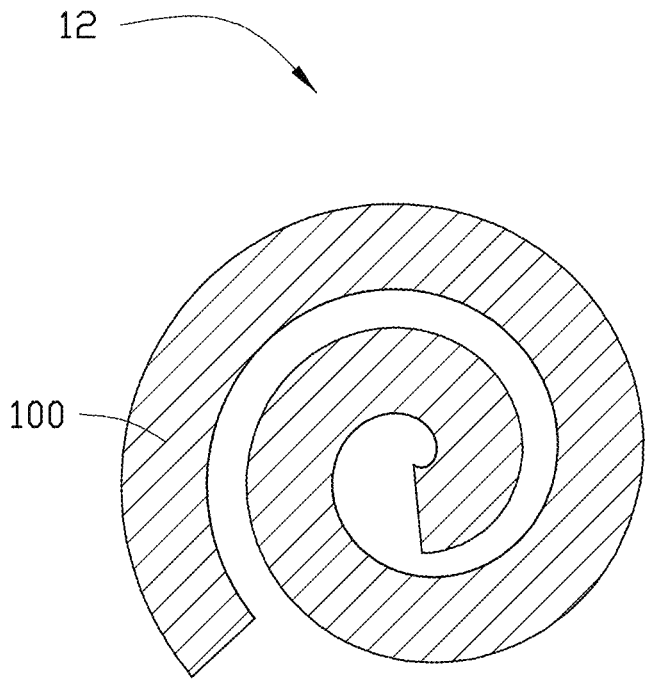
FIG. 5 is a cross-sectional view of the emission portion of the carbon nanotube field emitter of FIG. 4.
Figure 6:
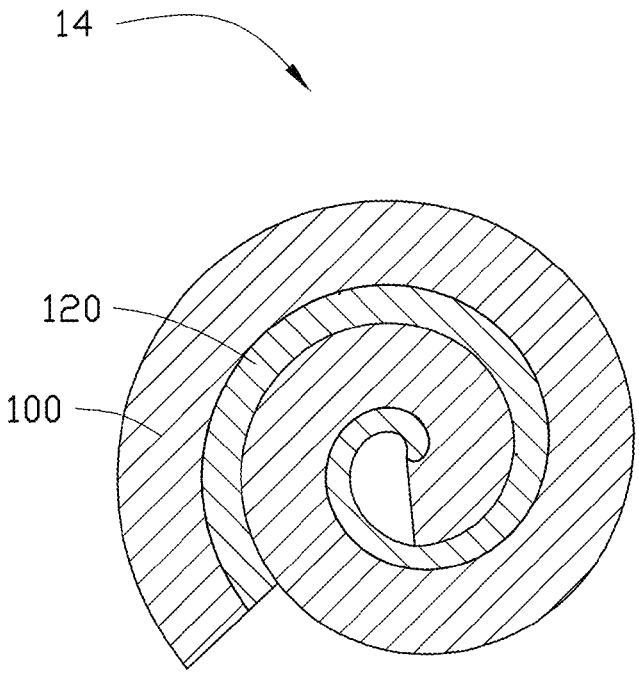
FIG. 6 is a cross-sectional view of the supporting portion of the carbon nanotube field emitter of FIG. 4.

The carbon nanotube field emitter 10 made by the method as described above is shown in FIG. 4, FIG. 5 and FIG. 6. The carbon nanotube field emitter 10 is a single rolled structure, which is composed of the emission portion 12 and the supporting portion 14. The emission portion 12 and the supporting portion 14 are formed as one piece. The emission portion 12 has a first end face and the supporting portion 14 has a second end face substantially parallel to the first end face.

The emission portion 12 can comprise or consist of a carbon nanotube layer 100 rolled around the first direction X, which forms a first rolled structure. Specifically, the first rolled structure of the emission portion 12 is formed by rolling the second area 1024 of the carbon nanotube layer 100. There is a gap between every two adjacent layers of the first rolled structure and the size of the gap is substantially equal to the thickness of the metal layer 120.

The supporting portion 14 can comprise or consist of a metal layer 120 and a carbon nanotube layer 100 stacked with each other and rolled around the first direction X, which forms a second rolled structure. More specifically, the second rolled structure of the supporting portion 14 is formed by rolling the stacked structure of the first area 1022 of the carbon nanotube layer 100 and the metal layer 120. There is no gap between each two adjacent layers of the second rolled structure. The outermost layer of the second rolled structure is the carbon nanotube layer 100, while the innermost layer of which is the metal layer 120.

Figure 7:
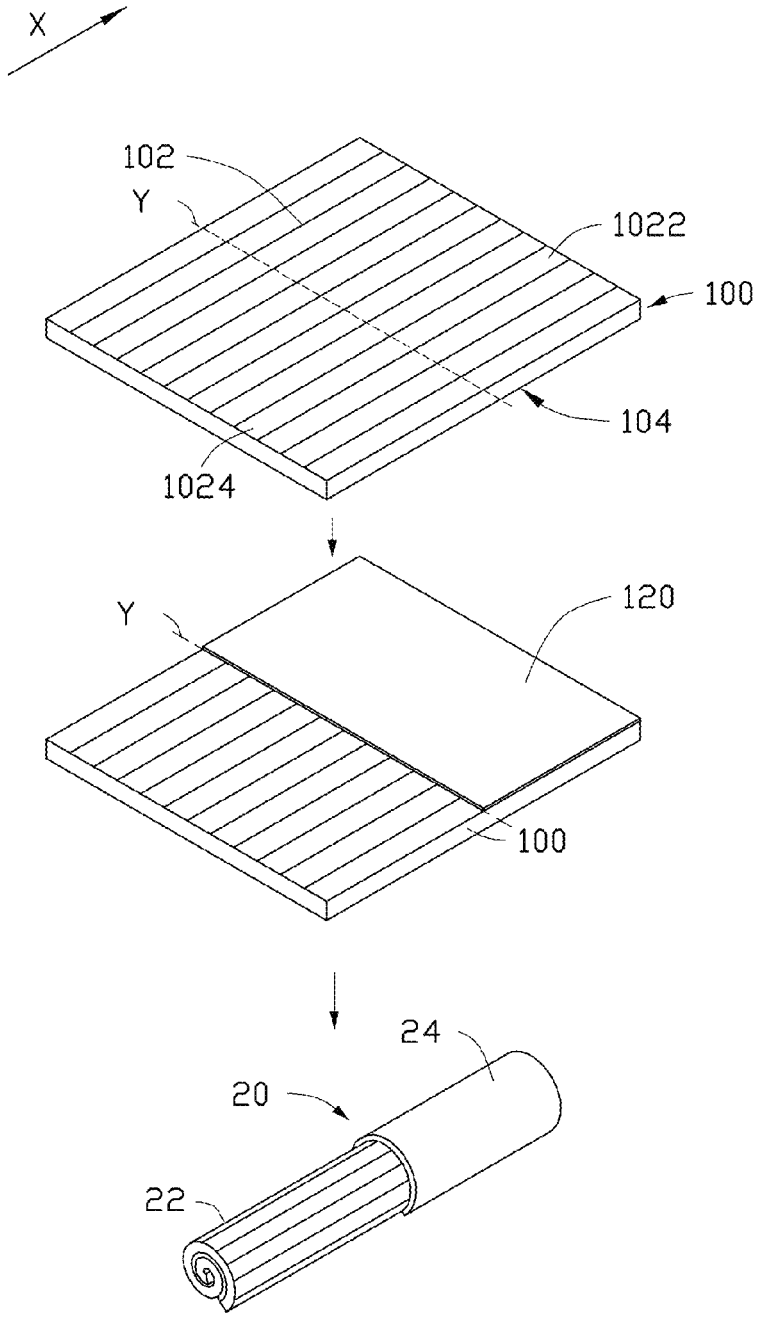
FIG. 7 is a schematic flowchart of a method for making carbon nanotube field emitter according to another embodiment.

Referring to FIG. 7, a method for making a carbon nanotube field emitter 20 according to another embodiment includes the steps of:

(S1) providing a carbon nanotube layer 100 having a first surface 102 and a second surface 104 opposite to each other, wherein the first surface 102 is divided into a first area 1022 and a second area 1024 along a first direction X by a line Y;

(S2) coating a metal layer 120 on the first area 1022; and (S3) taking the second surface 104 as an inner surface and rolling the coated carbon nanotube layer 100 around the first direction X to form the carbon nanotube field emitter 20.

The only difference between the method as shown in FIG. 7 and the method as shown in FIG. 1 is the selection of the inner surface while rolling the carbon nanotube layer 100 in step (S3).

Figure 8:
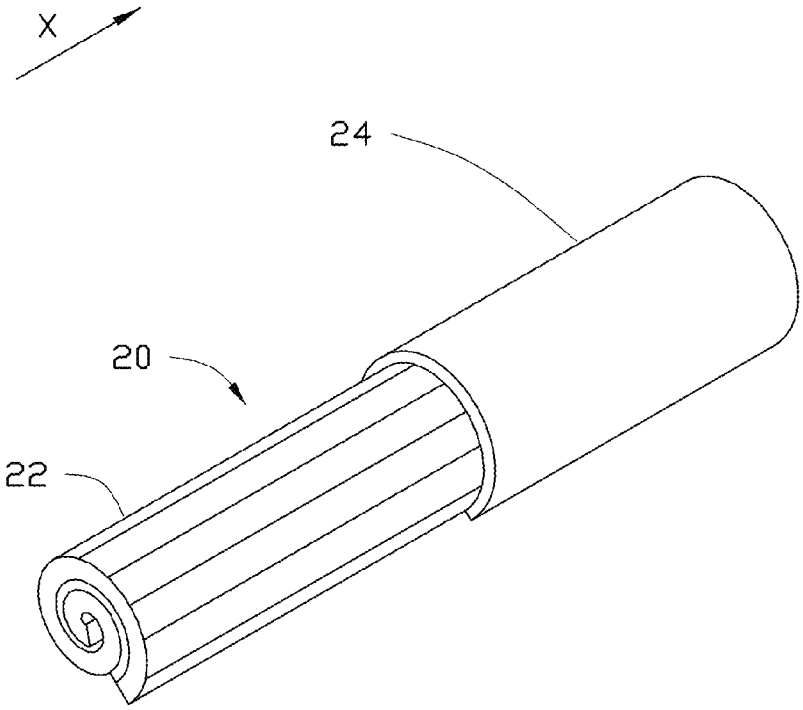
FIG. 8 is a schematic diagram of a carbon nanotube field emitter made by the method of FIG. 7.
Figure 9:
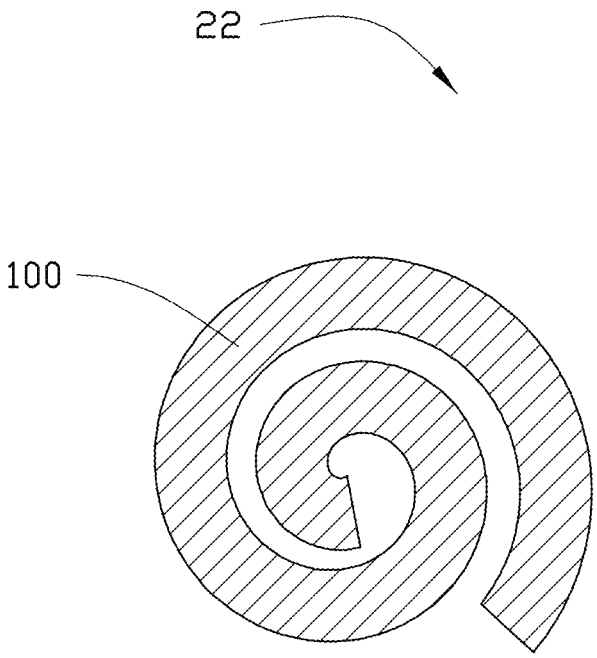
FIG. 9 is a cross-sectional view of the emission portion of the carbon nanotube field emitter of FIG. 8.
Figure 10:
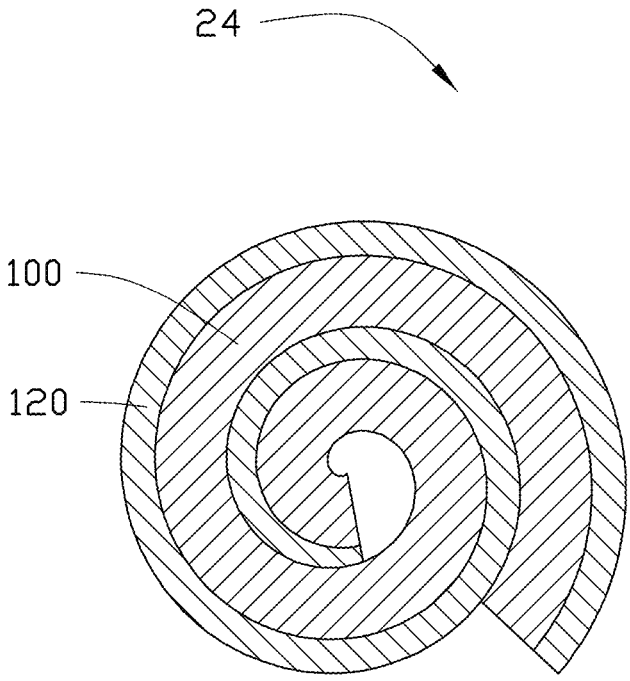
FIG. 10 is a cross-sectional view of the supporting portion of the carbon nanotube field emitter of FIG. 8.

The carbon nanotube field emitter 20 made by the method as described above is shown in FIG. 8, FIG. 9 and FIG. 10. The carbon nanotube field emitter 20 is a single rolled structure, which is composed of the emission portion 22 and the supporting portion 24. The emission portion 22 and the supporting portion 24 are formed as one piece. The emission portion 22 has a first end face and the supporting portion 24 has a second end face substantially parallel to the first end face.

The emission portion 22 can comprise or consist of a carbon nanotube layer 100 rolled around the first direction X which forms a first rolled structure. Specifically, the first rolled structure of the emission portion 22 is formed by rolling the second area 1024 of the carbon nanotube layer 100. There is a gap between each two adjacent layers of the first rolled structure and the size of the gap is equal to the thickness of the metal layer 120.

The supporting portion 24 can comprise or consist of a metal layer 120 and a carbon nanotube layer 100 stacked with each other and rolled around the first direction X, which forms a third rolled structure. Specifically, the third rolled structure of the supporting portion 24 is formed by rolling the stacked structure of the first area 1022 of the carbon nanotube layer 100 and the metal layer 120. There is no gap between each two adjacent layers of the third rolled structure. The outermost layer of the third rolled structure is the metal layer 120, while the innermost layer is the carbon nanotube layer 100.

Figure 11:
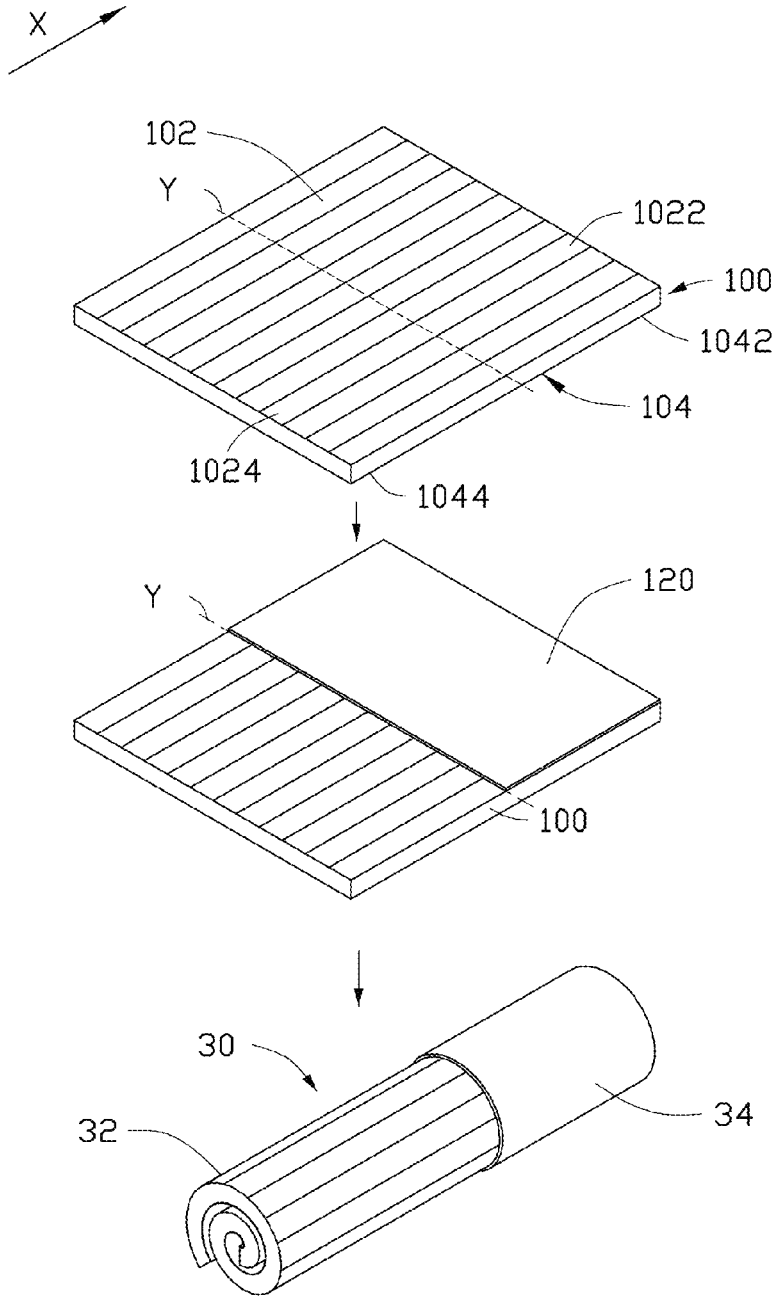
FIG. 11 is a schematic flowchart of a method for making carbon nanotube field emitter according to another embodiment.

Referring to FIG. 11, a method for making a carbon nanotube field emitter 30 according to another embodiment includes the steps of:

(S1) providing a carbon nanotube layer 100 having a first surface 102 and a second surface 104 opposite to each other, wherein the first surface 102 is divided into a first area 1022 and a second area 1024 along a first direction X by a line Y while the second surface 104 is divided into a third area 1042 and a fourth area 1044 along the first direction by the line Y, the first area 1022 being opposite to the third area 1042 and the second area 1024 being opposite to the fourth area 1044;

(S2) coating the first area 1022 and the third area 1042 with a metal layer 120 simultaneously; and (S3) rolling the coated carbon nanotube layer 100 around the first direction X to form the carbon nanotube field emitter 30.

The main difference between the method as shown in FIG. 11 and the method as shown in FIG. 1 is the area in the carbon nanotube layer 100 where the metal layer 120 is coated in step (S2).

Figure 12:
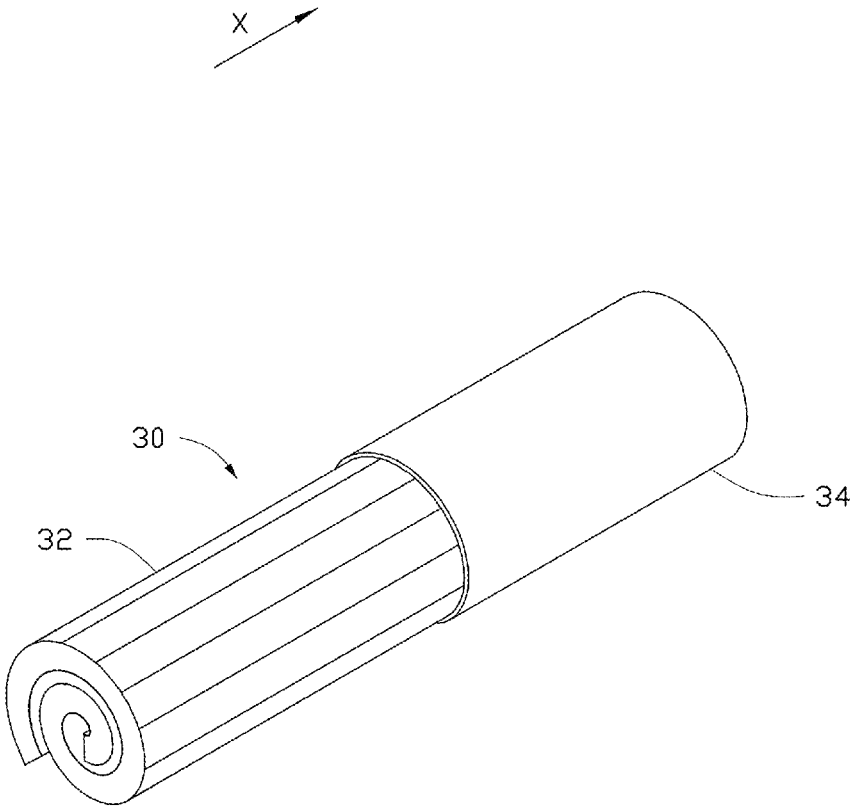
FIG. 12 is a schematic diagram of a carbon nanotube field emitter made by the method of FIG. 11.
Figure 13:
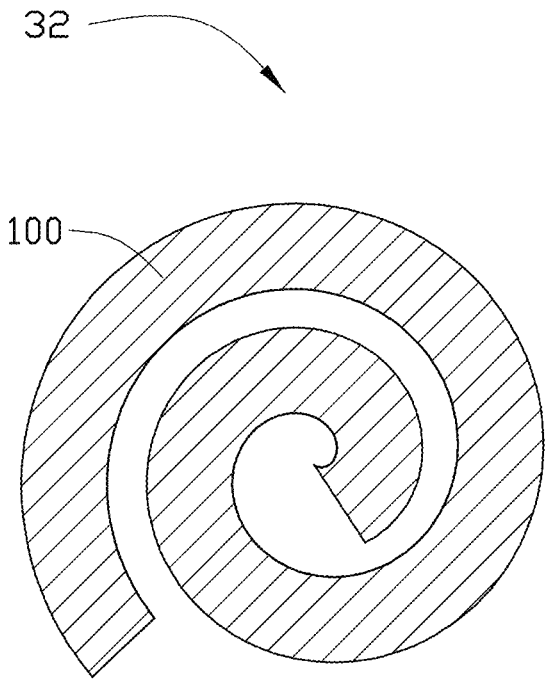
FIG. 13 is a cross-sectional view of the emission portion of the carbon nanotube field emitter of FIG. 12.
Figure 14:
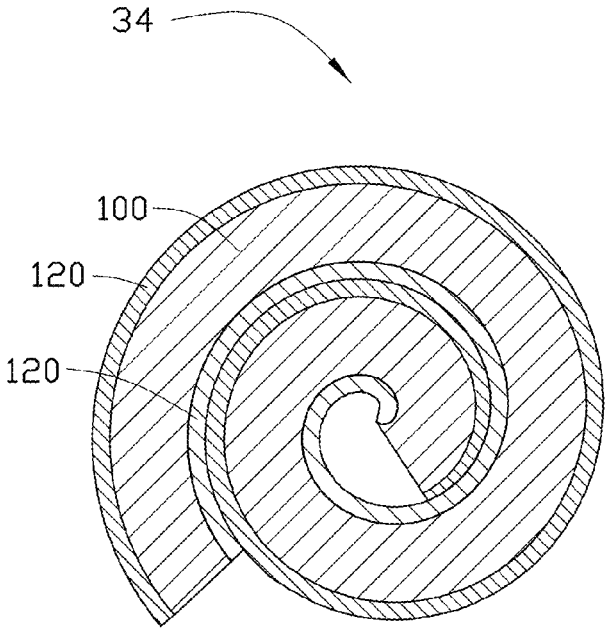
FIG. 14 is a cross-sectional view of the supporting portion of the carbon nanotube field emitter of FIG. 12.

The carbon nanotube field emitter 30 made by the method as described above is shown in FIG. 12 and FIG. 13. The carbon nanotube field emitter 30 is a single rolled structure, composed of the emission portion 32 and the supporting portion 34. The emission portion 32 and the supporting portion 34 are formed as one piece. The emission portion 32 has a first end face and the supporting portion 34 has a second end face substantially parallel to the first end face.

The emission portion 32 can comprise or consist of a carbon nanotube layer 100 rolled around the first direction X which forms a first rolled structure. More specifically, the first rolled structure of the emission portion 32 is formed by rolling the second area 1024 of the carbon nanotube layer 100. There is a gap between each two adjacent layers of the first rolled structure and the size of the gap is about twice the thickness of the metal layer 120.

The supporting portion 34 consists of two metal layers 120 and a carbon nanotube layer 100 stacked with each other and rolled around the first direction X, which forms a fourth rolled structure. Specifically, the fourth rolled structure of the supporting portion 34 is formed by rolling the sandwich structure of the two metal layers 120 and the carbon nanotube layer 100 therebetween. There is no gap between each two adjacent layers of the fourth rolled structure. Both the outermost layer and the innermost layer of the fourth rolled structure are metal layers 120.

Figure 15:
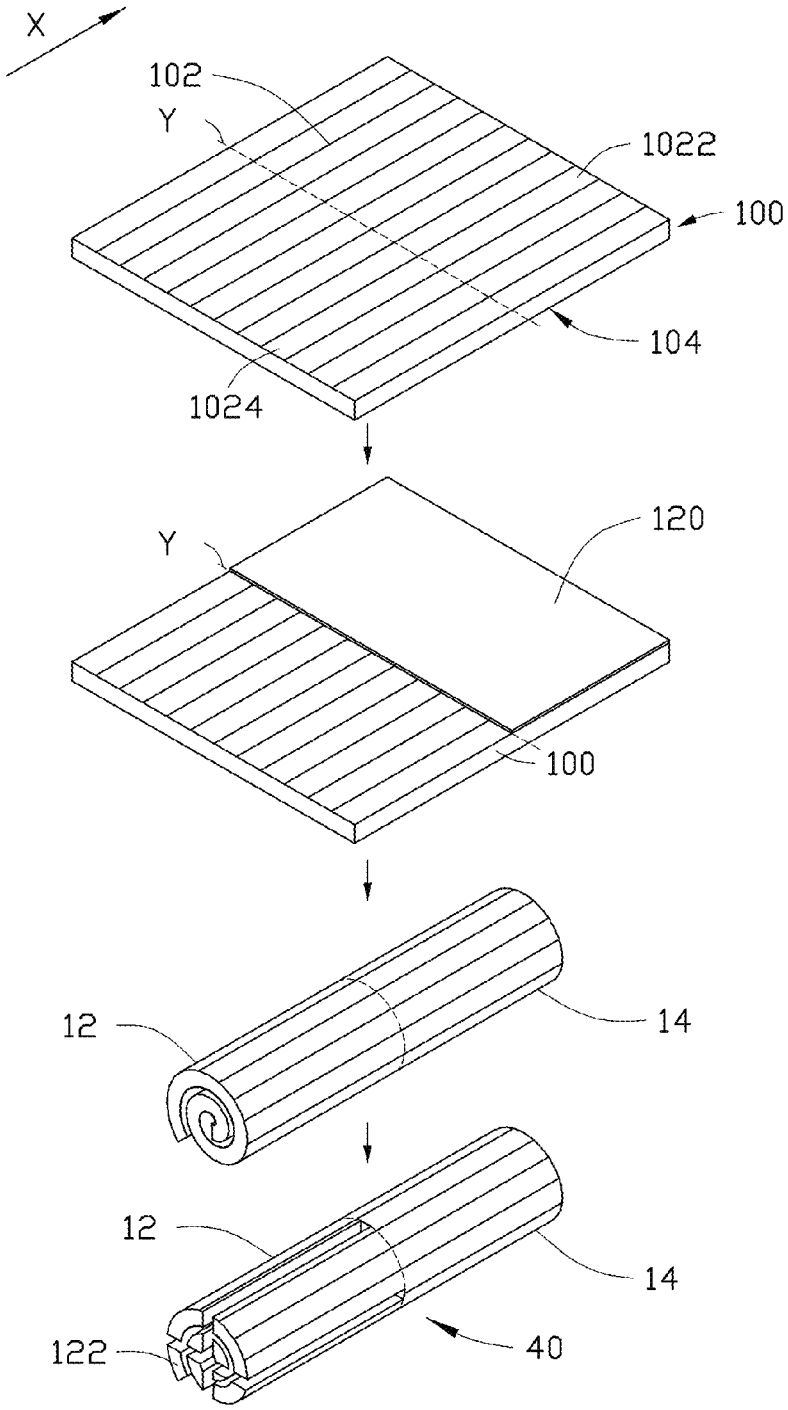
FIG. 15 is a schematic flowchart of a method for making carbon nanotube field emitter according to another embodiment.

Referring to FIG. 15, a method for making a carbon nanotube field emitter 40 according to another embodiment includes the steps of:

(S1) providing a carbon nanotube layer 100 having a first surface 102 and a second surface 104 opposite to each other, wherein the first surface 102 is divided into a first area 1022 and a second area 1024 along a first direction X by a line Y;

(S2) coating a metal layer 120 on the first area 1022;

(S3) taking the first surface 102 as an inner surface and rolling the coated carbon nanotube layer 100 around the first direction X to form a carbon nanotube field emitter 10, wherein the carbon nanotube field emitter 10 includes an emission portion 12; and (S4) cutting the emission portion 12 to form a plurality of emission tips 122, and transforming the carbon nanotube field emitter 10 to the carbon nanotube field emitter 40.

The only difference between the method as shown in FIG. 15 and the method as shown in FIG. 1 is the step (S4).

In step (S4), the cutting process is executed by a laser in one embodiment. Defining $\alpha$ as an angle between a cutting direction and the first direction X, and the angle $\alpha$ is equal to or larger than 0 degrees and smaller than or equal to 5 degrees. In one embodiment, the cutting direction is substantially parallel to the first direction X. The power of the laser is not restricted. The cutting process can be executed in a vacuum atmosphere or an active gas atmosphere.

Figure 16:
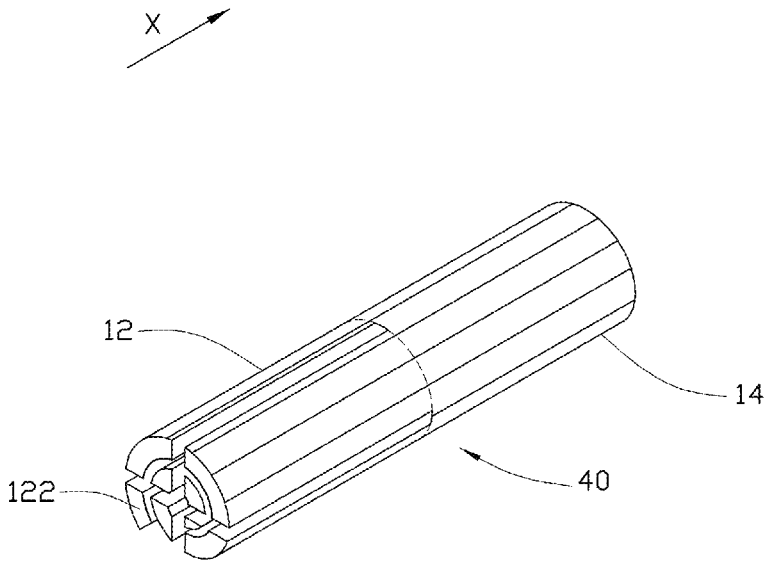
FIG. 16 is a schematic diagram of a carbon nanotube field emitter made by the method of FIG. 15.

The carbon nanotube field emitter 40 made by the method as described above is shown in FIG. 16. The carbon nanotube field emitter 40 is a single rolled structure, which is composed of the emission portion 12 and a supporting portion 14. The emission portion 12 and the supporting portion 14 are formed as one piece.

The emission portion 12 can comprise or consist of a plurality of carbon nanotubes which form a plurality of emission tips 122. The plurality of emission tips 122 are spaced from each other.

The supporting portion 14 consists of a metal layer 120 and a carbon nanotube layer 100 stacked with each other and rolled around the first direction X, which form a second rolled structure. More specifically, the second rolled structure of the supporting portion 14 is formed by rolling the stacked structure of the first area 1022 of the carbon nanotube layer 100 and the metal layer 120. There is no gap between each two adjacent layers of the second rolled structure. The outermost layer of the second rolled structure is the carbon nanotube layer 100, while the innermost layer is the metal layer 120.

Figure 17:
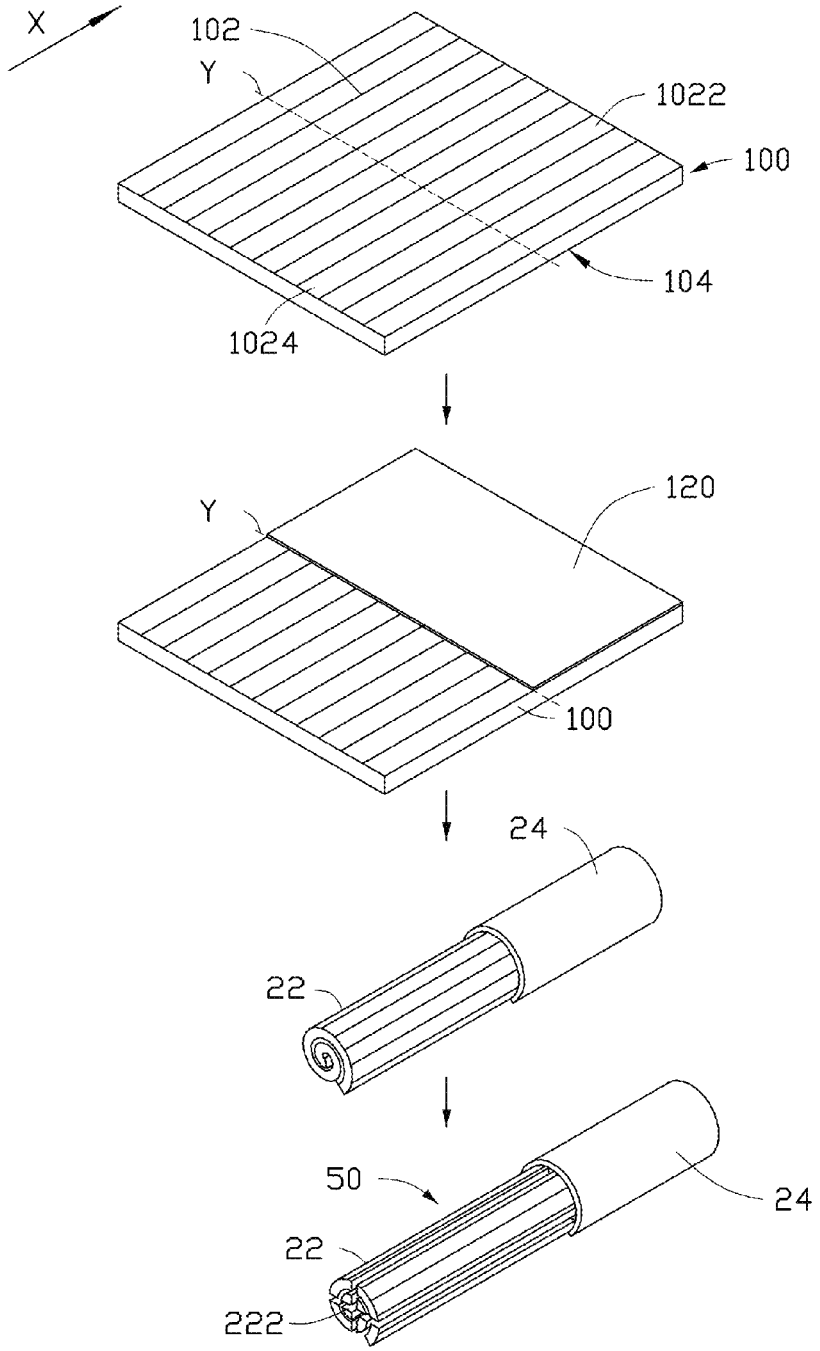
FIG. 17 is a schematic flowchart of a method for making carbon nanotube field emitter according to another embodiment.

Referring to FIG. 17, a method for making a carbon nanotube field emitter 50 according to another embodiment includes steps of:

(S1) providing a carbon nanotube layer 100 having a first surface 102 and a second surface 104 opposite to each other, wherein the first surface 102 is divided into a first area 1022 and a second area 1024 along a first direction X by a line Y;

(S2) coating a metal layer 120 on the first area 1022;

(S3) taking the second surface 104 as an inner surface and rolling the coated carbon nanotube layer 100 around the first direction X to form a carbon nanotube field emitter 20, wherein the carbon nanotube field emitter 20 includes an emission portion 22; and (S4) cutting the emission portion 22 to form a plurality of emission tips 222, and transforming the carbon nanotube field emitter 20 to the carbon nanotube field emitter 50.

The only difference between the method as shown in FIG. 17 and the method as shown in FIG. 7 is the step (S4).

In step (S4), the cutting process is executed by a laser in one embodiment. An angle α between a cutting direction and the first direction X is equal to or larger than 0 degrees and smaller than or equal to 5 degrees. In one embodiment, the cutting direction is parallel to the first direction X. The power of the laser is not restricted. The cutting process can be executed in a vacuum atmosphere or an active gas atmosphere.

Figure 18:
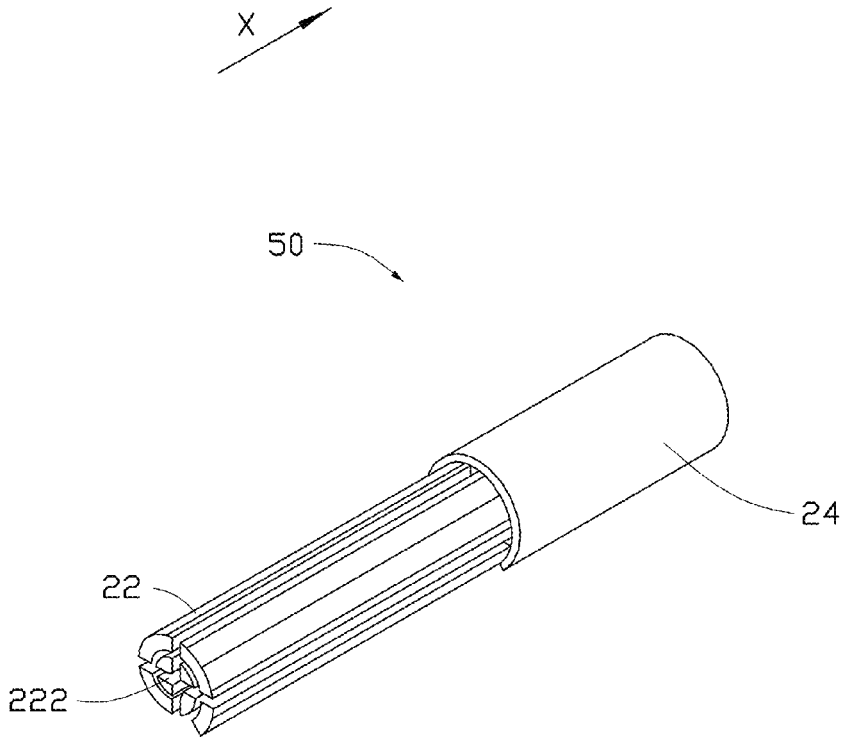
FIG. 18 is a schematic diagram of a carbon nanotube field emitter made by the method of FIG. 17.

The carbon nanotube field emitter 50 made by the method as described above is shown in FIG. 18. The carbon nanotube field emitter 50 is a single rolled structure, which is composed of the emission portion 22 and the supporting portion 24. The emission portion 22 and the supporting portion 24 are formed as one piece.

The emission portion 22 can comprise or consist of a plurality of carbon nanotubes which form a plurality of emission tips 222. The plurality of emission tips 222 are spaced from each other.

The supporting portion 24 can comprise or consist of a metal layer 120 and a carbon nanotube layer 100 stacked with each other and rolled around the first direction X, which form a third rolled structure. Specifically, the third rolled structure of the supporting portion 24 is formed by rolling the stacked structure of the first area 1022 of the carbon nanotube layer 100 and the metal layer 120. There is no gap between each two adjacent layers of the third rolled structure. The outermost layer of the third rolled structure is the metal layer 120, while the innermost layer of is the carbon nanotube layer 100.

Figure 19:
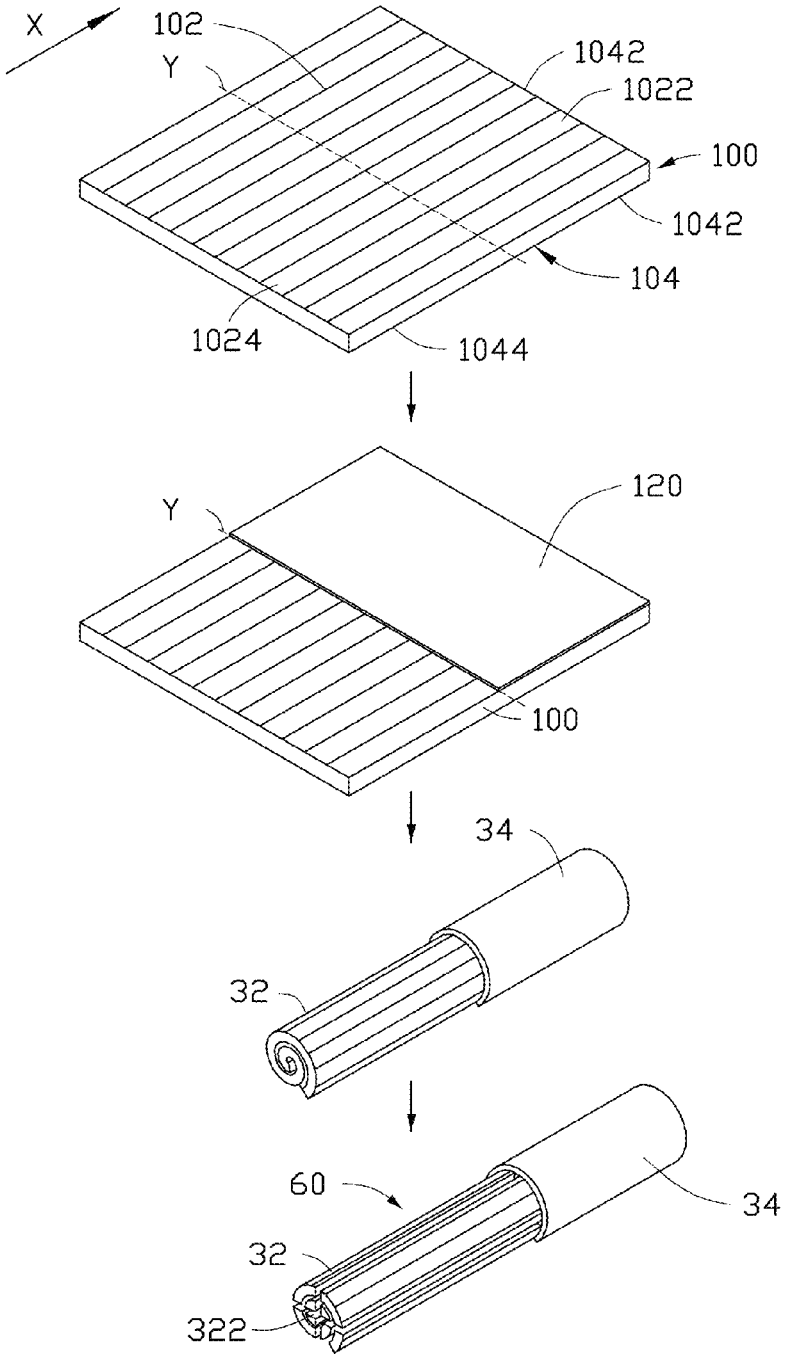
FIG. 19 is a schematic flowchart of a method for making carbon nanotube field emitter according to another embodiment.

Referring to FIG. 19, a method for making a carbon nanotube field emitter 60 according to another embodiment includes the steps of:

(S1) providing a carbon nanotube layer 100 having a first surface 102 and a second surface 104 opposite to each other, wherein the first surface 102 is divided into a first area 1022 and a second area 1024 along a first direction X by a line Y while the second surface 104 is divided into a third area 1042 and a fourth area 1044 along the first direction X by the line Y, the first area 1022 being opposite to the third area 1042 and the second area 1024 being opposite to the fourth area 1044;

(S2) coating the first area 1022 and the third area 1042 with a metal layer 120 simultaneously;

(S3) rolling the coated carbon nanotube layer 100 around the first direction X to form a carbon nanotube field emitter 30, wherein the carbon nanotube field emitter 30 includes an emission portion 32; and (S4) cutting the emission portion 32 to form a plurality of emission tips 322, and transforming the carbon nanotube field emitter 30 to the carbon nanotube field emitter 60.

The only difference between the method as shown in FIG. 19 and the method as shown in FIG. 11 is the step (S4).

In step (S4), the cutting process is executed by a laser in one embodiment. An angle α between a cutting direction and the first direction X is equal to or larger than 0 degrees and smaller than or equal to 5 degrees. In one embodiment, the cutting direction is parallel to the first direction X. The power of the laser is not restricted. The cutting process can be executed in a vacuum atmosphere or an active gas atmosphere.

Figure 20:
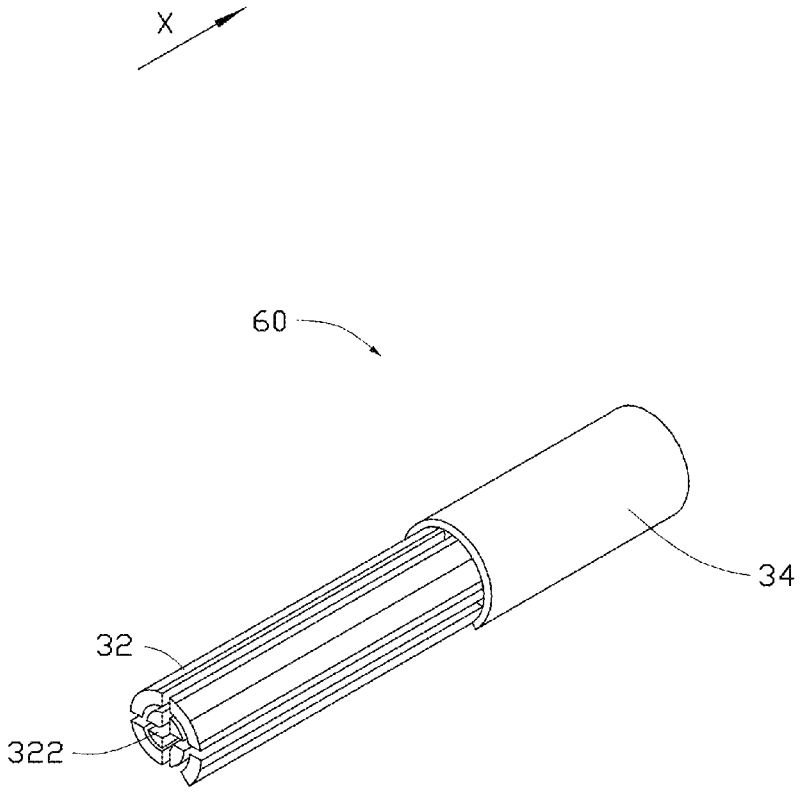
FIG. 20 is a schematic diagram of a carbon nanotube field emitter made by the method of FIG. 19.

The carbon nanotube field emitter 60 made by the method as described above is shown in FIG. 20. The carbon nanotube field emitter 60 is a single rolled structure, which is composed of the emission portion 32 and a supporting portion 34. The emission portion 32 and the supporting portion 34 are formed as one piece.

The emission portion 32 can comprise or consist of a plurality of carbon nanotubes which form a plurality of emission tips 322. The plurality of emission tips 322 are spaced from each other.

The supporting portion 34 can comprise or consist of two metal layers 120 and a carbon nanotube layer 100 stacked with each other and rolled around the first direction X, which form a fourth rolled structure. Specifically, the fourth rolled structure of the supporting portion 34 is formed by rolling the sandwich structure of the two metal layers 120 and the carbon nanotube layer 100 therebetween. There is no gap between each two adjacent layers of the fourth rolled structure. Both of the outermost layer and the innermost layer of the fourth rolled structure are the metal layer 120.

Figure 21:
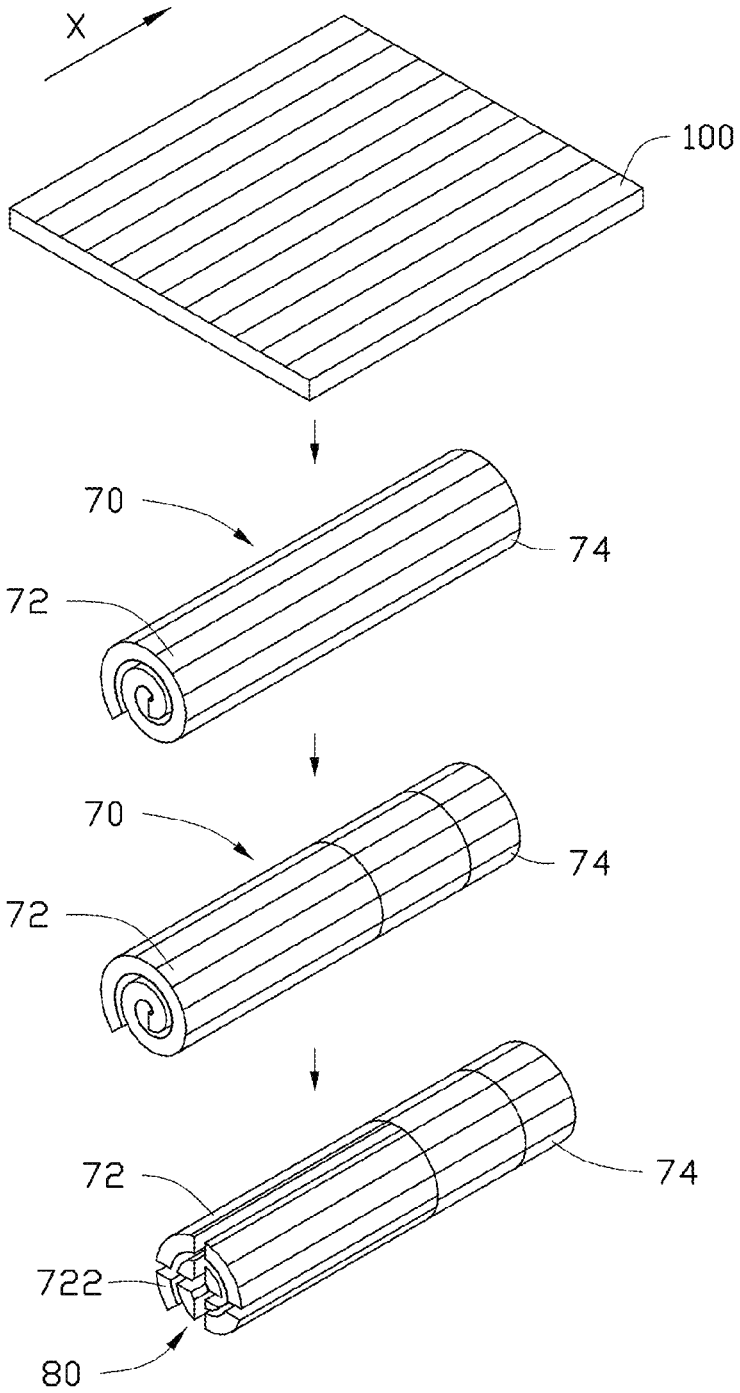
FIG. 21 is a schematic flowchart of a method for making carbon nanotube field emitter according to another embodiment.

Referring to FIG. 21, a method for making a carbon nanotube field emitter 70 according to another embodiment includes the steps of:

(S1) providing a carbon nanotube layer 100;

(S2) rolling the carbon nanotube layer 100 along a first direction X to form the carbon nanotube field emitter 70, wherein the carbon nanotube field emitter 70 includes an emission portion 72 and a supporting portion 74; and (S3) fastening the carbon nanotube field emitter 70 in the supporting portion 74.

In step (S2), the obtained carbon nanotube field emitter 70 is a single rolled structure, which is composed of the emission portion 72 and the supporting portion 74. The emission portion 72 and the supporting portion 74 are formed as one piece.

In step (S3), the carbon nanotube field emitter 70 can be fastened by a metal wire or a metal film.

The emission portion 72 of the carbon nanotube field emitter 70 can further be cut into a plurality of emission tips 722 by a laser with the same process as shown in step (S4) of FIG. 19. The carbon nanotube field emitter 70 is then transformed to a carbon nanotube field emitter 80.

The carbon nanotube field emitter 70 made by the method as described above shown in FIG. 21 is a single rolled structure, which is composed of the emission portion 72 and the supporting portion 74. The emission portion 72 and the supporting portion 74 are formed as one piece. The carbon nanotube field emitter 70 can comprise or consist of a carbon nanotube layer 100 rolled around the first direction X to form the single rolled structure. There is no gap between each two adjacent layers of the single rolled structure.

Figure 22:
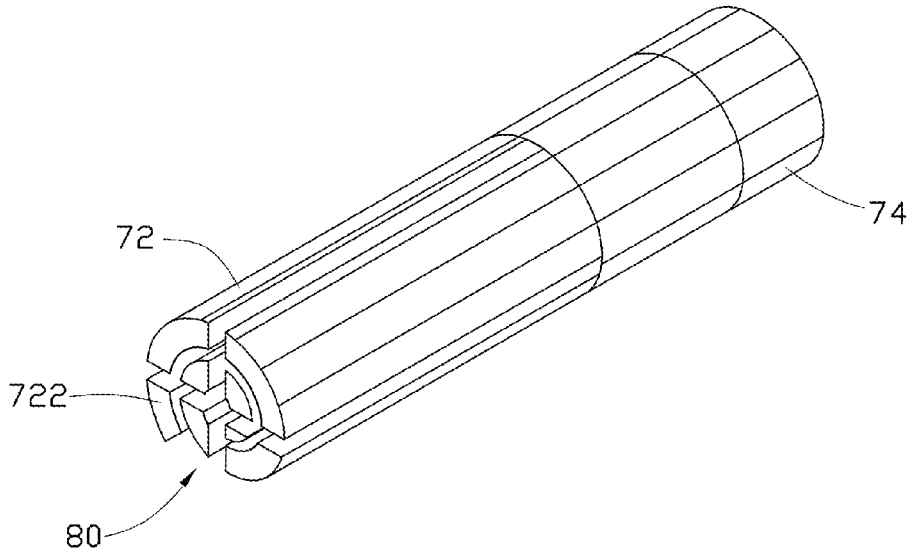
FIG. 22 is a schematic diagram of a carbon nanotube field emitter made by the method of FIG. 21.

The carbon nanotube field emitter 80 is shown in FIG. 22. The difference between the carbon nanotube field emitter 80 and the carbon nanotube field emitter 70 is that there is a plurality of emission tips 722 spaced from each other in the emission portion 72 of the carbon nanotube field emitter 80.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. A method for making a carbon nanotube field emitter comprising:

(a) providing a carbon nanotube layer having a first surface and a second surface opposite to each other, wherein the first surface is divided into a first area and a second area along a first direction by a line;

(b) coating a metal layer on the first area to obtain a coated carbon nanotube layer; and (c) rolling the coated carbon nanotube layer around the first direction to form a rolled coated carbon nanotube layer.

2. The method as claimed in claim 1, wherein the step (c) comprises forming an emission portion by rolling the second area of the carbon nanotube layer, and forming a supporting portion by rolling the coated first area of the carbon nanotube layer, the emission portion and the supporting portion being formed as one piece.

3. The method as claimed in claim 2, further comprising (d) cutting the emission portion into a plurality of emission tips.

4. The method as claimed in claim 3, wherein in the step (d), the emission portion is cut by a laser.

5. The method as claimed in claim 4, wherein an angle $\alpha$ formed between a cutting direction and the first direction is equal to or larger than 0 degrees and smaller than or equal to 5 degrees.

6. The method as claimed in claim 1, wherein in the step (c), the first surface is an inner surface of the rolled coated carbon nanotube layer.

7. The method as claimed in claim 1, wherein in the step (c), the second surface is an inner surface of the rolled coated carbon nanotube layer.

8. The method as claimed in claim 1, wherein in the step (a), the carbon nanotube layer consists of one or a plurality of carbon nanotube drawn films.

9. The method as claimed in claim 8, wherein the carbon nanotube drawn film consists of a plurality of oriented carbon nanotubes joined end to end by van der Waals attractive force.

10. A method for making a carbon nanotube field emitter comprising:

(a) providing a carbon nanotube layer having a first surface and a second surface opposite to each other, wherein the first surface is divided into a first area and a second area along a first direction by a line while the second surface is divided into a third area and a fourth area along the first direction by the line, the first area is opposite to the third area, and the second area is opposite to the fourth area;

(b) coating the first area and the third area with a metal layer simultaneously; and (c) rolling the coated carbon nanotube layer around the first direction to form the carbon nanotube field emitter.

11. The method as claimed in claim 10, wherein the step (c) comprises forming an emission portion by rolling the second area and the fourth area of the carbon nanotube layer, and forming a supporting portion by rolling the coated first area and third area of the carbon nanotube layer, the emission portion and the supporting portion being formed as one piece.

12. The method as claimed in claim 11, further comprising (d) cutting the emission portion into a plurality of emission tips.

13. The method as claimed in claim 12, wherein in the step (d), the emission portion is cut by a laser.

14. The method as claimed in claim 13, wherein an angle formed between a cutting direction and the first direction is equal to or larger than 0 degrees and smaller than or equal to 5 degrees.

15. The method as claimed in claim 11, wherein in the step (a), the carbon nanotube layer consists of a plurality of oriented carbon nanotubes joined end to end by van der Waals attractive force.

16. A method for making a carbon nanotube field emitter comprising:

(a) providing a carbon nanotube layer having a first surface and a second surface opposite to each other, wherein the first surface is divided into a first area and a second area along a first direction;

(b) rolling the carbon nanotube layer along the first direction to form a rolled carbon nanotube layer; and (c) fastening the rolled carbon nanotube layer.

17. The method as claimed in claim 16, wherein in the step (c), the carbon nanotube field emitter is composed of an emission portion and a supporting portion, and the supporting portion is fastened.

18. The method as claimed in claim 17, further comprising (d) cutting the emission portion into a plurality of emission tips.

19. The method as claimed in claim 18, wherein in the step (d), the emission portion is cut by a laser.

20. The method as claimed in claim 17, wherein in the step (c), the carbon nanotube field emitter is fastened by a metal wire or a metal film.

* * * * *